United States Patent [19]

Rothe et al.

[11] Patent Number: 4,629,165

[45] Date of Patent: Dec. 16, 1986

[54] COOLING PIPE ARRANGEMENT FOR A COOLING SECTION FOR RAPID COOLING OF ROLLED WIRE OR BAR MATERIAL

[75] Inventors: Herbert Rothe, Baden-Baden; Karl Haase, Kehl, both of Fed. Rep. of Germany

[73] Assignee: Badische Stahlwerke AG, Kehl, Fed. Rep. of Germany

[21] Appl. No.: 670,058

[22] Filed: Nov. 9, 1984

[30] Foreign Application Priority Data

Nov. 23, 1983 [DE] Fed. Rep. of Germany ..... 3342322

[51] Int. Cl.[4] ..... C21D 1/18

[52] U.S. Cl. ..... 266/114; 266/259; 72/201

[58] Field of Search ..... 266/111–113, 266/114, 102, 103; 134/122 R, 64 R, 64 P; 72/201, 286

[56] References Cited

U.S. PATENT DOCUMENTS

| | | | |
|---|---|---|---|
| 4,197,730 | 4/1980 | Paulitsch | 72/201 |
| 4,210,010 | 7/1980 | Vlad et al. | 72/201 |
| 4,329,861 | 5/1982 | Griffiths | 72/14 |

FOREIGN PATENT DOCUMENTS

| | | |
|---|---|---|
| 055072 | 6/1982 | European Pat. Off. . |
| 8019956 | 10/1981 | Fed. Rep. of Germany . |
| 995952 | 2/1983 | U.S.S.R. . |

*Primary Examiner*—Christopher W. Brody

[57] ABSTRACT

A cooling pipe arrangement (1) includes a pipe portion (2) in which two gripping elements (3) are arranged, with a coil spring (6) gripped between the gripping elements (3). The coil spring is surrounded by an annular space (15) into which opens a duct (16) for the coolant. The fluid which is supplied by way of the duct is conducted through the gap (19) between the turns of the coil spring, on to the rolled material which is conveyed through the cooling pipe arrangement. The width of the gap (19) may be varied by means of a setting ring (22).

10 Claims, 5 Drawing Figures

COOLING PIPE ARRANGEMENT FOR A COOLING SECTION FOR RAPID COOLING OF ROLLED WIRE OR BAR MATERIAL

DESCRIPTION

The invention relates to a cooling pipe arrangement for rapid cooling of rolled wire or rolled bar material, having a pipe portion in which are disposed two sleeve-like gripping elements between which an insert member having a gap as a through-flow opening for coolant is gripped, and an annular space which is defined by the insert member and a portion of the inside wall surface of the pipe portion, and which communicates through a duct with a connection for the coolant.

Cooling pipe arrangements of that kind are used for cooling the rolled material in or downstream of a rolling train. On the one hand, such cooling pipe arrangements are intended to ensure that the temperatures of the rolled material does not exceed certain limit values, within the rolling train, in order thereby to avoid unacceptable decarbonisation or carbide separation. On the other hand, the final rolling temperature on the finishing table must be accurately set, in order to provide for a given structure in the rolled material. Finally, controlled cooling downstream of the last rolling mill is intended to provide for given mechanical properties in the rolled material.

German patent specification No. 2 726 473 discloses a cooling pipe arrangement comprising two guide sleeves which are disposed at a spacing from each other. A plurality of bars are disposed at a spacing from each other on a pitch circle about the longitudinal axis of the cooling pipe arrangement, being disposed so as to converge from one guide sleeve to the other. Thus, slot-like through-flow openings for the cooling fluid are formed between the individual bars. A pipe portion which is fitted over the two guide sleeves and which is sealed with respect thereto by means of sealing elements forms, arcund the bars, an annular space which is in communication by way of ducts with a connection for the cooling fluid. In that arrangement, the cooling fluid may be introduced tangentially so that the cooling fluid performs a rotary mcvement about the rolled material and the heat transfer effect is enhanced by the turbulence of the cooling fluid.

As is known, temperature differences within the rolled material should not exceed certain values, in order to ensure that the material remains crack-free and has a uniform and regular structure. Therefore, the throughput of cooling agent is to be adjusted in dependence on the respective diameter of the rolled material, temperature or quality of steel. As, in regard to the known cooling pipe arrangements, it is not readily possible for the throughput of coolant and thus the intensity of the cooling action to be matched to the cooling output required, the installation usually includes an expensive regulating system with control members in the feed lines to the individual cooling pipes.

The object of the present invention is to provide a cooling pipe arrangement which, while being of a simple design configuration, permits adjustment in respect of the throughput of coolant and thus provides for adaptation to the required level of cooling output prescribed for the cooling pipe arrangement in question.

That object is achieved by the features recited in claim 1. Advantageous embodiments of the invention are set forth in the other claims.

The construction according to the invention is distinguished by being of a particularly simple design configuration. A coil spring is gripped between two sleeve-like gripping elements which preferably at the same time form the means for guiding the rolled material, the turns of the coil spring normally being held at a spacing from each other so as to provide a helical gap serving as a flow opening for the cooling fluid to flow therethrough. Although it is also possible to use a tension spring, if it is suitably gripped between the gripping elements, the spring employed is preferably a compression spring. The cross section of the wire forming the coil spring is preferably round. The inside diameter of the coil spring is sufficiently large on the one hand to prevent contact with the rolled material and on the other hand to provide an adequate intermediate space around the rolled material, for the cooling fluid to flow therein.

The two gripping elements are secured in a pipe portion which at the same time defines an annular space around the coil spring, a duct for the supply of cooling fluid opening into the annular space. Besides the gripping elements which are required in any case for guiding the rolled material and besides seals and fixing means, the cooling pipe arrangement therefore only additionally comprises a coil spring and a pipe portion provided with a water connection. In that arrangement, the gripping elements may be of identical configuration. That means that the cooling pipe arrangement is of a surprisingly simple construction. Nonetheless, the coil spring can be extended or compressed to a greater or lesser degree, by means of the gripping elements, simply by altering the spring-gripping length between the gripping elements, and the change in the width of the gap between the turns of the spring, which is caused by the coil spring being extended or compressed to a greater or lesser degree, causes the throughput of coolant to be adapted to the desired level of cooling output.

That principle not only permits easy and individual adjustment of the throughput of coolant when assembling the cooling pipe arrangement, but, with simple structural means, it also affords the possibility, in regard to a cooling pipe arrangement which is incorporated into the cooling section, individually to vary the throughput of coolant and to adapt it to the desired level of cooling output. For that purpose, it is only necessary for the construction to be such that the spring-gripping length defined between the gripping elements can be altered. A particularly suitable structure for that purpose is a screwthread connection, either directly between at least one of the gripping elements and the pipe portion, or by way of a setting ring. The width of the gap between the turns of the coil spring does not have to be constant. Thus, at the side at which the rolled material passes into the spring, the width of the gap between the turns of the spring may be larger than at the exit side for the rolled material. That is possible for example by the coil spring being wound with a varying pitch. It is also possible to achieve such a characteristic by the coil spring being replaced by a series array of at least two coil springs of different pitches and possibly different spring rates. Moreover, it is possible for a plurality of coil springs to be disposed in succession within a pipe portion, the coil springs each being gripped between respective gripping elements and each spring having associated therewith a respective annular space with a duct for the cooling fluid. Units each comprising a coil spring gripped between two gripping elements, which are arranged in succession in a pipe portion, may be respectively connected by a rigid sleeve which provides for a smooth guiding action in respect of the flow of coolant which is entrained by the rolled material. By virtue of arrangements of that kind, the cooling characteristic may be varied within wide limits. At this point it should also be mentioned that the throughput of coolant through the helical gap formed between the turns of the coil spring is generally so adjusted that it is at a lower level than the possible flow through the duct which communicates with the annular space. That arrangement is intended to ensure that the annular space is completely filled with cooling fluid and the rolled material is uniformly cooled over its entire periphery. By virtue of the duct opening into the annular chamber eccentrically, it is possible to cause the cooling water to rotate about the rolled material, thereby to enhance the cooling action. The possibility of adjusting the throughput of coolant also includes the situation where the coil spring is compressed until adjacent turns bear against each other, whereby the flow of coolant therethrough is completely cut off.

Embodiments of the invention are described in greater detail hereinafter with reference to the drawings in which.

Figure 1:
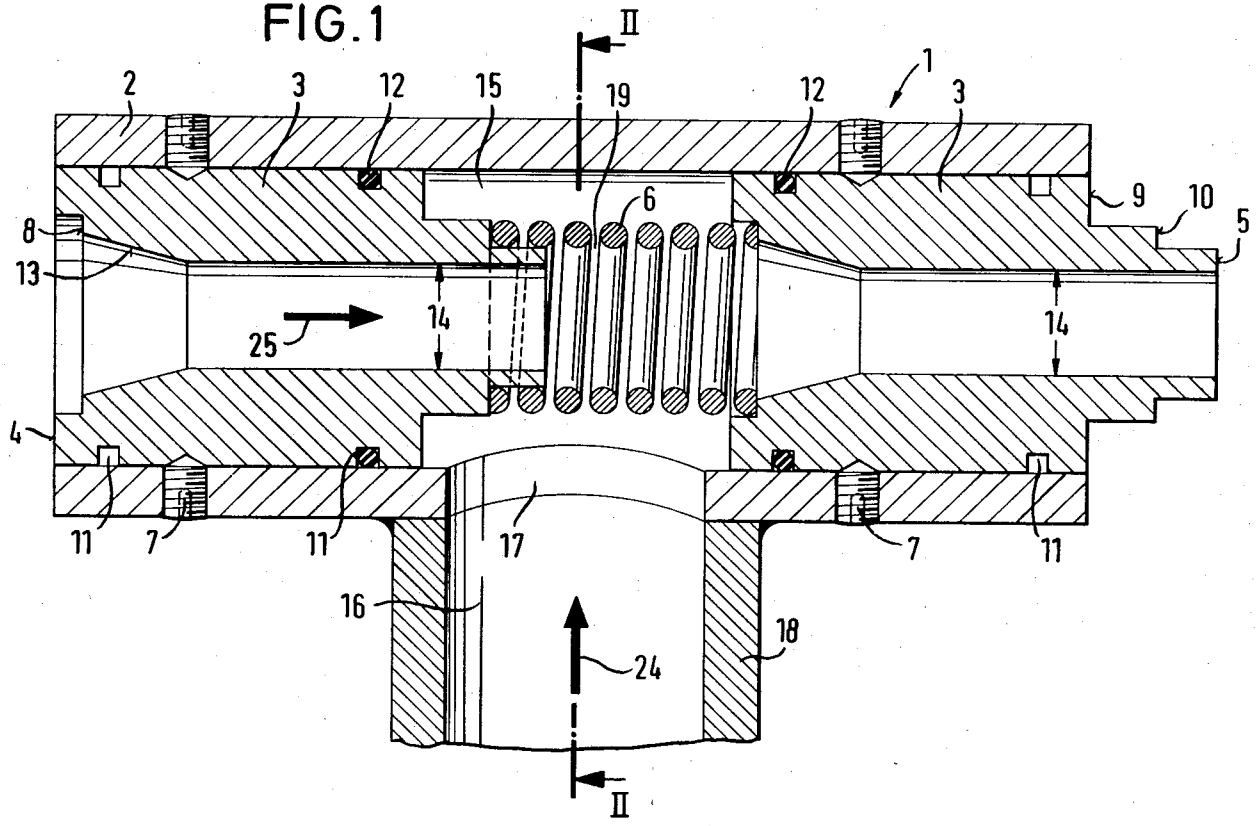
FIG. 1 shows a view in longitudinal section of a cooling pipe arrangement.

The cooling pipe arrangement 1 illustrated in FIG. 1 is part of a cooling section which includes a plurality of such cooling pipe arrangements.

The cooling pipe arrangement 1 includes two clamping or gripping elements 3 which are of identical configuration, in a pipe portion 2. A coil spring 6 is gripped between the end faces 4 and 5 of the gripping elements 3, which face towards each other. The two gripping elements 3 are fixed in the pipe portion 2 by means of screws 7. The left-hand end face 4 of each of the gripping elements 3 has an annular recess 8 while the right-hand end face has annular shoulders 9 and 10. The coil spring 6 is carried with its left-hand end on the inner annular shoulder 10 of the left-hand gripping element 3, and with its right-hand end in the annular recess 8 in the right-hand gripping element 3.

Each gripping element has two annular grooves 11. A respective sealing element 12 is provided in each of the annular grooves 11 which are adjacent to the coil spring.

The two gripping elements 3 are in the form of guide sleeves for the rolled material and for that purpose have a funnel-like portion 13 at their entry end at which the rolled material enters. The inside diameter of the coil spring 6 is sufficiently larger than the inside diameter 14 of the gripping elements 3, to ensure that the rolled material does not come into contact with the coil spring. On the other hand, a sufficiently large annular space 15 must be left between the coil spring 6 and the inside wall surface of the tube portion 2, to ensure that the coolant flows into the interior of the coil spring radially and uniformly substantially over the periphery of the coil spring. The annular space 15 communicates with a connection for the cooling fluid, by way of a duct 16. In the illustrated embodiment, the duct is formed by a circular opening 17 in the tube portion 2 and a connecting pipe 18. In the view shown in FIG. 1, the cooling fluid flows upwardly (as indicated by the arrow 24) through the duct 16 into the annular chamber 15, from which it passes into the interior of the coil spring 6 through the helical gap 19 formed by the coil spring 6.

The rolled material passes through the cooling pipe arrangement 1 from the left-hand side towards the right-hand side (as indicated by the arrow 25). The inside diameter 14 of the sleeve-like gripping elements 3 is about 1.5 to 3 times the diameter of the rolled material. The spacing between the rolled material and the inside of the coil spring 6 approximately corresponds to the spacing between the outside of the coil spring and the inside wall surface of the tube portion 2.

The cooling pipe arrangement illustrated in FIG. 1 is very easy to produce. Portions of standardised, commercially available pipes can be used as the pipe portions. After the opening 17 has been bored in the pipe portion, the connecting pipe 18 is welded into position. Then, one of the two gripping elements 3 which is already fitted with a seal 12 is inserted into the pipe portion 2 and fixed in position by screws 7. The coil spring 6 is then inserted, followed finally by the other gripping element 3 which is fixed in position with screws.

In the illustrated embodiment, the length of the coil spring 6 and the two gripping elements 3 is such that the end face 4 of the left-hand gripping element and the annular shoulder 9 of the right-hand gripping element terminate flush with the pipe portion 2. The through-flow cross-section through the helical gap 19 is smaller than the through-flow cross-section of the duct 16, thereby to ensure that in the operational condition, the annular space 15 is always filled with cooling fluid. The sleeve-like gripping elements 3 and the coil spring 6 are arranged coaxially within the pipe portion 2 so that the coil spring 6 is approximately throughout at the same spacing from the inside wall surface of the pipe portion 2. However, for reasons connected with coolant flow, it may be desirable for the centre lines of the gripping elements 3 and the coil spring 6 to be displaced somewhat parallel with respect to the centre line of the pipe portion 2 in order thereby to provide an annular space 15 which is of a cross-section that varies over the periphery thereof. In addition, it may be desirable for the width of the helical gap 19 not to be constant, as illustrated, but to be such that for example it decreases from left to right. For that purpose, the coil spring only needs to be wound with a varying pitch. Finally, it is also possible for the coil spring 6 to be of such a configuration that it tapers conically from one end to the other.

Figure 2:
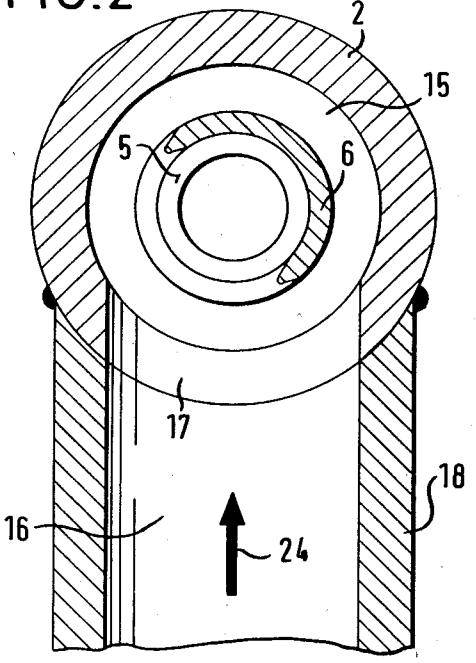
FIG. 2 shows a view in section taken along line II—II in FIG. 1.

As can be seen from the cross-sectional view shown in FIG. 2, in the illustrated embodiment the duct 16 opens centrally into the annular space 15, that is to say, the centreline of the connecting pipe 18 intersects the centreline of the pipe portion 2 which at the same time represents the centre line of the gripping elements 3 and the coil spring 6.

Figure 3:
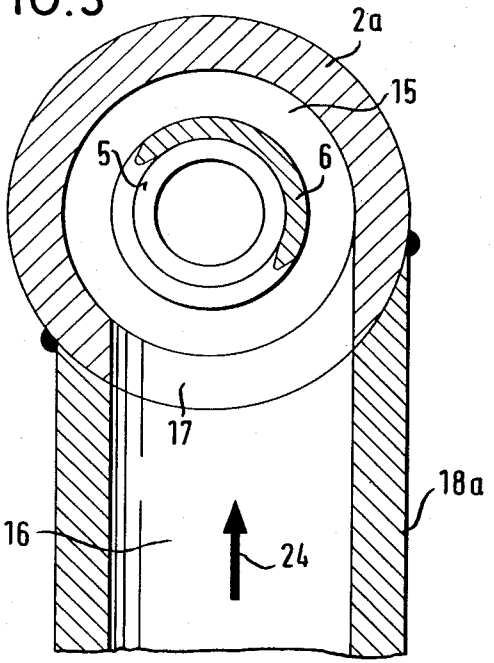
FIG. 3 shows a view corresponding to that shown in FIG. 2, of a modified embodiment of a cooling pipe arrangement.

FIG. 3 shows an embodiment which is modified in relation thereto, wherein the duct 16 opens eccentrically into the annular space 15. For that purpose, the centre line of the connecting pipe 18*a* is offset in a parallel position, in comparison with the embodiment shown in FIG. 2, that is to say, the centre line of the connecting pipe 18*a* no longer intersects the centre line of the pipe portion 2*a*. In that way, a tangential flow is generated within the annular space 15, and that flow, through the gap 19 between the turns of the coil spring, results in rotational movement of the cooling fluid around the rolled material. Therefore, that cooling action takes place with a greater degree of turbulence than in the embodiment illustrated in FIG. 2.

Figure 4:
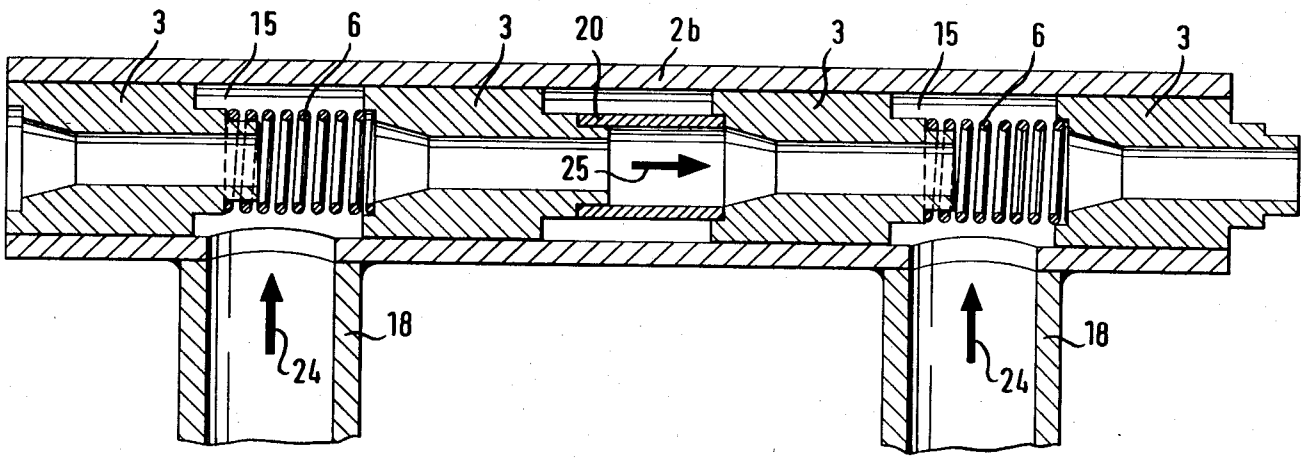
FIG. 4 shows a view in longitudinal section of a cooling pipe arrangement comprising two units.

FIG. 4 illustrates a cooling pipe arrangement comprising a pipe portion 2*b* in which two units each comprising a coil spring 6 gripped between two gripping or clamping elements 3 are disposed in succession, with the two units being connected by a rigid sleeve 20. Associated with each of the coil springs is an annular space 15 and a duct 16 for the supply flow of cooling fluid. The rigid sleeve 20 is gripped in position in the same manner as the coil springs 6, namely between the inner shoulder 10 of the one gripping element 3 and the annular recess 8 of the next gripping element 3. The rigid sleeve 20 provides an equalising section, the length of which can be determined by the length of the rigid sleeve 20.

Instead of the rigid sleeve 20, it is also possible to use another element which is capable of passing the cooling fluid therethrough, and the arrangement may have a duct which opens into the annular space around that element and through which the cooling fluid supplied by way of the duct 16 is at least partially discharged again.

Figure 5:
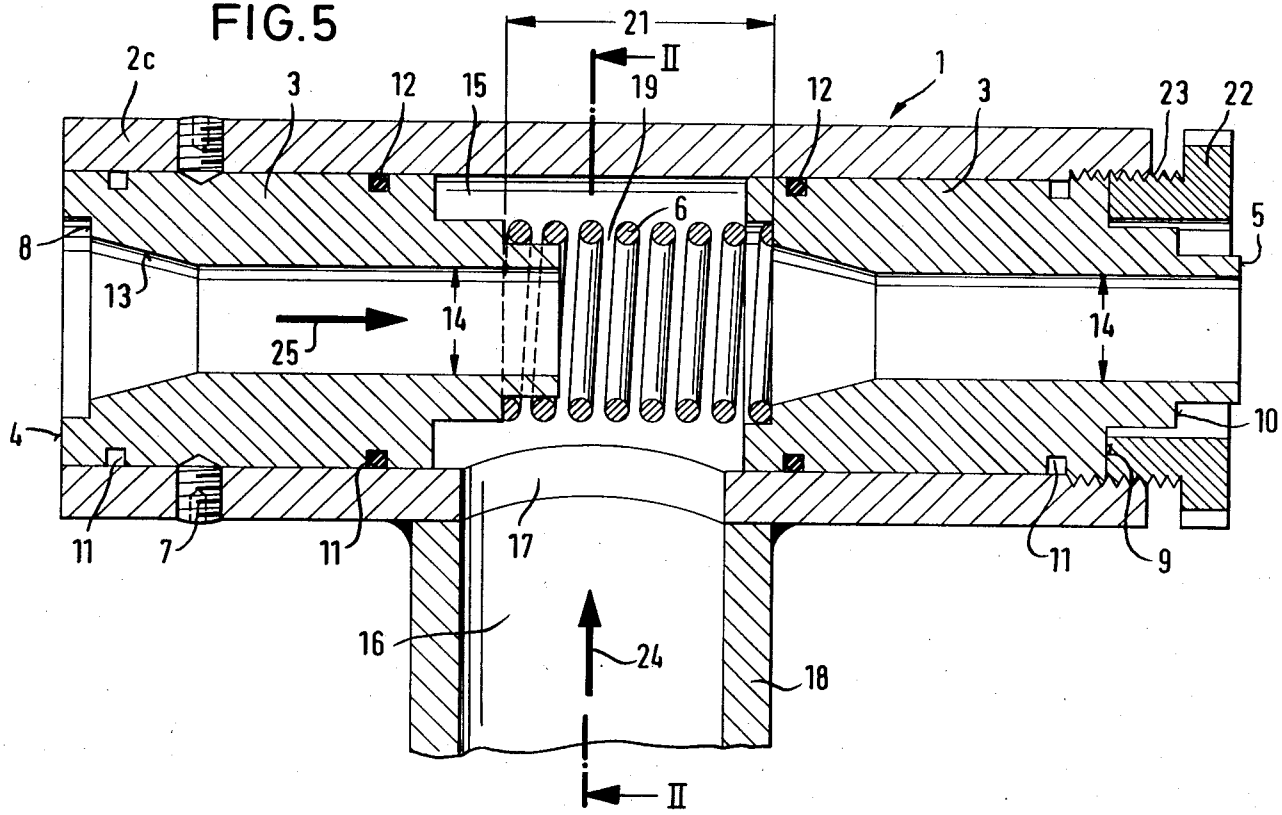
FIG. 5 shows a view in longitudinal section of a further embodiment of a cooling pipe arrangement.

FIG. 5 shows an embodiment of the invention in which it is easily possible, not only during manufacture but also in use of the cooling pipe arrangement, to adjust the through-flow cross-section for the cooling fluid through the helical gap 19 of the coil spring 6, and to adapt it to the required conditions. For that purpose, the coil-gripping length 21 as defined between two gripping elements 3 is variable. The embodiment illustrated in FIG. 5 corresponds in substance to that shown in FIG. 1. For the purposes of varying the gripping length 21, the right-hand gripping element 3 is mounted in such a way as to be longitudinally displaceable, and bears with its end face that is remote from the coil spring 6, in this case with the outer annular shoulder 9, against a setting ring 22 which is connected to the pipe portion 2*c* by means of a screwthread 23. For that purpose, the setting ring 22 is provided with a male screwthread and is screwed into a female screwthread at the right-hand end of the pipe portion 2*c*. Rotating the setting ring 22 causes the coil spring 6 to be compressed to a greater or lesser degree, whereby the width of the gap 19 can be reduced, over a wide range, down to a value of zero. The setting ring 22 is thus a simple means for adjusting and also cutting off the flow of cooling fluid which is supplied to the rolled material within the cooling pipe arrangement.

The screwthread connection could also be provided between the right-hand gripping element 3 and the pipe portion 2*c*. In that case, the right-hand gripping element would have to be rotated for the purposes of varying the spring-gripping length 21.

Suitable cooling agents are not just a cooling liquid and in this case more particularly water, but it would also be possible to use gaseous coolants.

We claim:

1. In a cooling pipe arrangement for rapid cooling of rolled wire on rolled bar material comprising a pipe portion in which are disposed two sleeve-like gripping elements between which an insert member having a gap as a through-flow opening for coolant is gripped, and an annular space which is defined by the insert member and a portion of the inside wall surface of the pipe portion and which communicates through a duct with a connection for the coolant, the improvement wherein the insert member is formed by a coil spring, the gripping elements are fixed in the pipe portion, and means are provided for varying the length of the spring between the gripping elements.

2. A cooling pipe arrangement as set forth in claim 1, wherein the gripping elements at the same time form guide means for the rolled material.

3. A cooling pipe arrangement as set forth in claim 1, wherein at least one of the gripping elements is connected to the pipe portion by way of a screwthread.

4. A cooling pipe arrangement as set forth in claim 1, wherein at least one of the gripping elements is mounted longitudinally displaceably and bears with an end face thereof that is remote from the coil spring against a setting ring which is connected to the pipe portion by a screwthread.

5. A cooling pipe arrangement as set forth in claim 1, wherein said gripping elements are of identical configuration.

6. A cooling pipe arrangement as set forth in claim 1, wherein said duct for the coolant is arranged transversely with respect to the longutidinal axis of the cooling pipe portion.

7. A cooling pipe arrangement as set forth in claim 6, wherein said duct for the coolant opens eccentrically into said annular space.

8. A cooling pipe arrangememt as set forth in claim 1, wherein at least two coil springs are arranged in succession in said pipe portion, gripped between respective gripping elements, and a duct for the coolant opens into each annular space around the coil springs.

9. A cooling pipe arrangement as set forth in claim 8, wherein at least two units each comprising a coil spring gripped between two gripping elements are arranged in succession in said pipe portion and the units are connected by a rigid sleeve.

10. A cooling pipe arrangement as set forth in claim 1, wherein said coil spring is formed with a varying width of gap between the turns of the spring.

* * * * *